US008646665B2

(12) United States Patent
Abushaev

(10) Patent No.: US 8,646,665 B2
(45) Date of Patent: Feb. 11, 2014

(54) SELF-LOADING HOLSTER FOR SEMI-AUTOMATIC OR AUTOMATIC PISTOLS

(76) Inventor: Evgeny Abushaev, Ottawa (CA)

( * ) Notice: Subject to any disclaimer, the term of this patent is extended or adjusted under 35 U.S.C. 154(b) by 434 days.

(21) Appl. No.: 12/567,108

(22) Filed: Sep. 25, 2009

(65) Prior Publication Data

US 2010/0170923 A1 Jul. 8, 2010

Related U.S. Application Data

(60) Provisional application No. 61/204,355, filed on Jan. 6, 2009.

(51) Int. Cl.
*F41C 33/02* (2006.01)

(52) U.S. Cl.
USPC ..... 224/243; 224/244; 224/912

(58) Field of Classification Search
USPC ..... 224/243, 244, 192, 193, 242, 911, 912; 42/106, 87
See application file for complete search history.

(56) References Cited

U.S. PATENT DOCUMENTS

| | | | | | |
|---|---|---|---|---|---|
| 3,763,587 | A * | 10/1973 | Firmalino | 42/106 |
| 3,804,306 | A * | 4/1974 | Azurin | 224/193 |
| 4,138,044 | A * | 2/1979 | Musgrave | 224/242 |
| 4,298,150 | A * | 11/1981 | Seldeen | 224/243 |
| 5,275,317 | A * | 1/1994 | Rogers et al. | 224/244 |
| 7,543,404 | B2 * | 6/2009 | Kovalchuk et al. | 42/106 |
| 7,591,402 | B2 * | 9/2009 | Rassias | 224/243 |
| 2006/0226185 | A1 * | 10/2006 | Har-Shen | 224/244 |
| 2007/0163164 | A1 * | 7/2007 | Avrahami et al. | 42/87 |
| 2007/0194067 | A1 * | 8/2007 | Lowe et al. | 224/244 |
| 2008/0093400 | A1 * | 4/2008 | Stevens | 224/243 |
| 2010/0219216 | A1 * | 9/2010 | Clark et al. | 224/243 |

* cited by examiner

*Primary Examiner* — Justin Larson
*Assistant Examiner* — Corey Skurdal
(74) *Attorney, Agent, or Firm* — James Marc Leas

(57) ABSTRACT

A pistol holster is disclosed that permits a pistol to be loaded while within the holster. To effect this, the holster body containing the lower portion of a pistol, slides downward relative to a slide bar component that holds the breach block of the pistol, allowing a live round of ammunition to be loaded into the pistol's firing chamber with a single hand action, to make the pistol ready for firing. The holster also contains one or more locks to prevent unintentional removal of the pistol from the holster.

10 Claims, 9 Drawing Sheets

SELF-LOADING HOLSTER FOR SEMI-AUTOMATIC OR AUTOMATIC PISTOLS

PRIOR APPLICATION DATA

The present application claims the benefit of prior provisional application 61/204,355, filed on Jan. 6, 2009, incorporated herein by reference in its entirety.

FIELD OF THE INVENTION

This invention generally relates to handgun holsters, and more specifically, to a holster with improved features to allow the loading of a live round of ammunition into the firing chamber of semi-automatic and automatic pistols.

BACKGROUND OF INVENTION

Some firearm holsters currently used by law enforcement officers for semi-automatic/automatic pistols have a two-step lock release process to allow the pistol to be withdrawn from the holster unit for emergencies.

Based on one of the popular holster model types, a right-handed police officer would depress a "thumb" lock release button on the left hand side, or body side of the holster unit, to unlock the "rear flip cap/strap" locking feature, and permit the officer to flip/rotate the cap/strap ninety degrees forward with his or her thumb, to clear the exit path for the pistol to be removed from the holster housing unit.

The officer must then depress the second lock release button, located near the pistol grip of the pistol, with his or her middle finger to release the breach frame locking measure, to allow the pistol to be removed from the holster unit.

Some of the holsters currently in use also restrict the positioning of the holster and pistol in a vertical position, parallel to the officer's body, and results in the holstered pistol to angle outward, away from the body. This "outward" angling of the holstered pistol offers greater risk of potential contact of the loaded pistol with furniture or doorframes.

Normally, to perform the loading of a semi-automatic/automatic pistol requires the use of two hands. One hand secures the pistol by the pistol grip. The other hand slides the upper spring-loaded frame portion, or "breach block" section of the pistol backwards, to allow a live round of ammunition to be loaded into the pistol's firing chamber from the pistol's ammunition storage magazine.

Once the spring-loaded breach block returns to its normal position, the pistol is now loaded and ready to fire.

The average timeframe for an officer to draw a pre-loaded pistol from its holstered position to a firing position during a police emergency is between 1.5 seconds to 2.9 seconds.

In a life-threatening emergency requiring the use of a firearm, this timeframe to draw a pistol is too long, and may result in injury or death of the police officer.

Based on the current regulations in certain regions in North America, police officers are required by law to have a live round of ammunition in the firing chamber of their pistol while on duty.

Performing their law enforcement duties with a loaded pistol in their holster is both unsafe and potentially life-threatening for both the officer and any innocent bystanders.

The unloading or removal of the live round of ammunition from the firing chamber of their service pistol at the end of the police officer's tour of duty, in a fatigued or tired state of mind, can and has resulted in the accidental discharge of the pistol, increasing the risk of injury to the officer and any bystanders.

SUMMARY OF INVENTION

Therefore there is a need for a new holster design which allows the loading of a live round of ammunition into the firing chamber of a pistol, while offering a more user-friendly approach of removing the pistol from the holster housing unit, based on a more natural hand positioning to de-activate the three spring-loaded safety lock release buttons.

The new design for a safer, self-loading firearm holster for semi-automatic or automatic pistols offers the police officer the option of having a loaded pistol in his or her holster, or to use the self-loading feature of the holster housing unit, to load the pistol.

This new firearm holster also offers a superior "secure locking configuration", insuring against the unauthorized removal of the pistol from the holster.

The holster consists of a holster body and a slide bar component, which move relative to one another and permit the carrying and loading within the holster of a semi-automatic or automatic pistol. The holster may be attached to a duty belt by means of a belt attachment, which allows the duty belt to be laced through the loop openings. The belt attachment is adjustably affixed to the slide bar component.

The holster body contains the lower portion of the pistol, and the slide bar component contains the breach block of the pistol. The slide bar component remains static in position in relation to the duty belt and user. In order to load the pistol while it's within the holster, the holster body moves down relative to the slide bar component, thereby cocking and loading the pistol.

The holster design also has five safety locks, which are disengaged by three lock releases: an index finger lock release, a middle finger lock release, and a thumb lock release. The middle finger lock release button disengages the first and second of five releasable locks, located on the pistol's trigger guard. The index finger lock release button disengages the third and fourth releasable locks, that is, the first releasable lock on the slide bar component of the pistol, and the releasable lock on the pistol's extract, or ejection window. The fifth releasable lock, a second locking point on the slide bar component is disengaged by the thumb lock release button.

LIST OF DRAWINGS

DETAILED DESCRIPTION OF THE INVENTION

Figure 1:
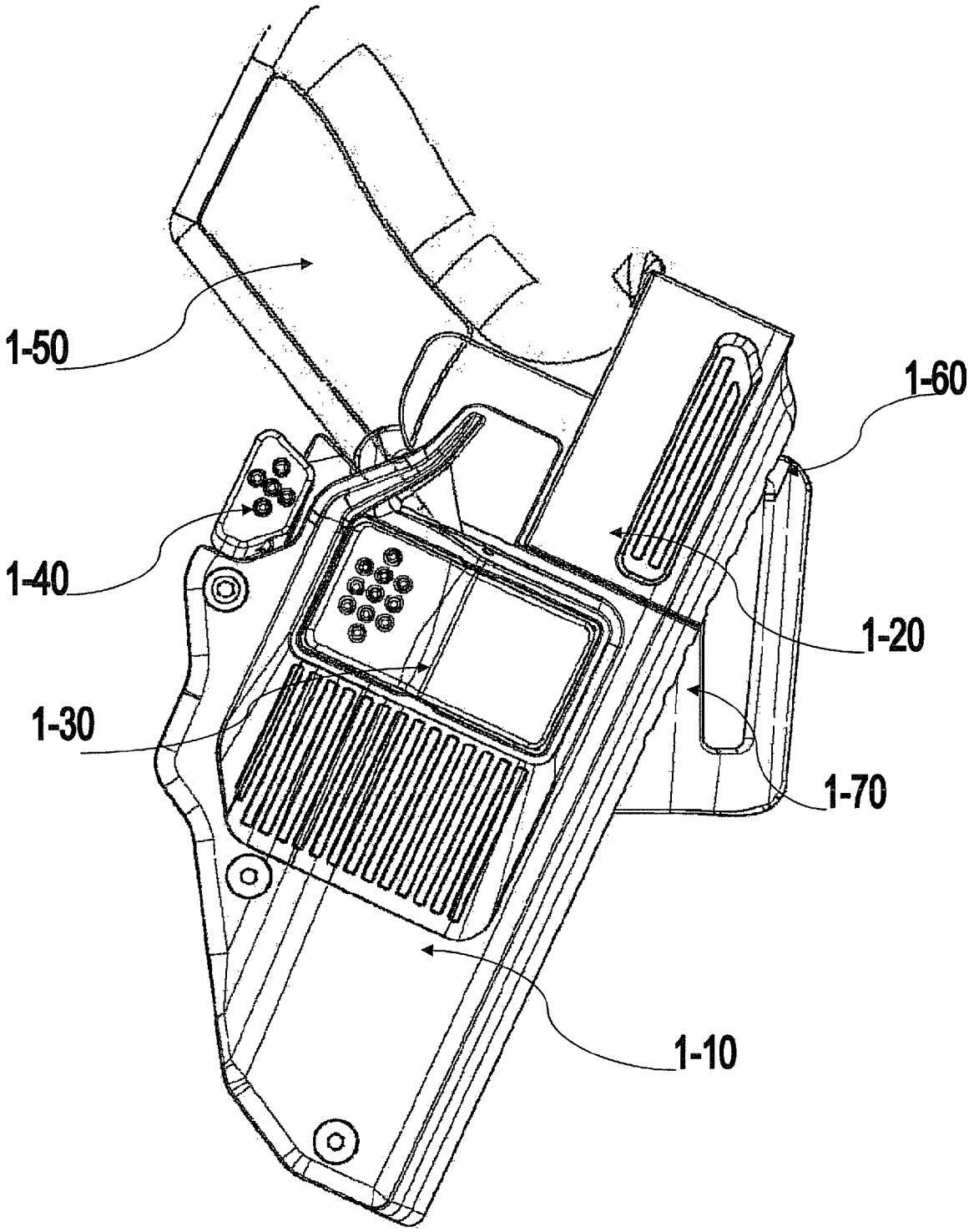
FIG. 1 is a side view of the self-loading holster carrying a semi-automatic pistol according to an embodiment of the invention.

With reference to FIG. 1, a pistol-loading holster is described, consisting of a holster body (1-10) and a slide bar component (1-20) which move relative to one another and permit the carrying and loading within the holster of a semi-automatic or automatic pistol (1-50). The holster is secured to a duty belt [not shown], by means of a belt attachment (1-70), which allows the duty belt to be laced through the loop openings of the belt attachment (1-60). The belt attachment (1-70) is in turn affixed to the slide bar component (1-20) by three metal bolts (3-100) [not shown]. One skilled in the art would appreciate that the holster body and slide bar component may be manufactured of carbon fiber or nylon, among other materials.

The holster body (1-10) is made of rigid carbon fibre nylon/plastic, molded for a specific model of pistol (1-50), for placement at the waist or upper thigh area of the user, on either the left or right side of the duty belt (not shown). The holster body (1-10) and the slide bar component (1-20) are operatively connected to each other by means of a spring [not shown], which urges the holster body (1-10) and slide bar component (1-20) together to a closed holster position, wherein the slide bar component (1-20) is contained within the holster body (1-10). The user exerts downward force on the holster body (1-10) to open the holster position, which force opposes that of the spring [not shown].

The middle finger lock release button (1-40) disengages the first and second releasable kicks, located on the pistol's trigger guard [not shown]. The index finger lock release button (1-30) disengages the third and fourth of five releasable locks, that is, the locking point on the slide bar component (1-20) of the pistol, and the locking point on the pistol's extract, or ejection window [not shown]. The fifth releasable lock, also on the slide bar component (1-20) is disengaged by the thumb lock release button (3-80) [not shown].

Figure 2:
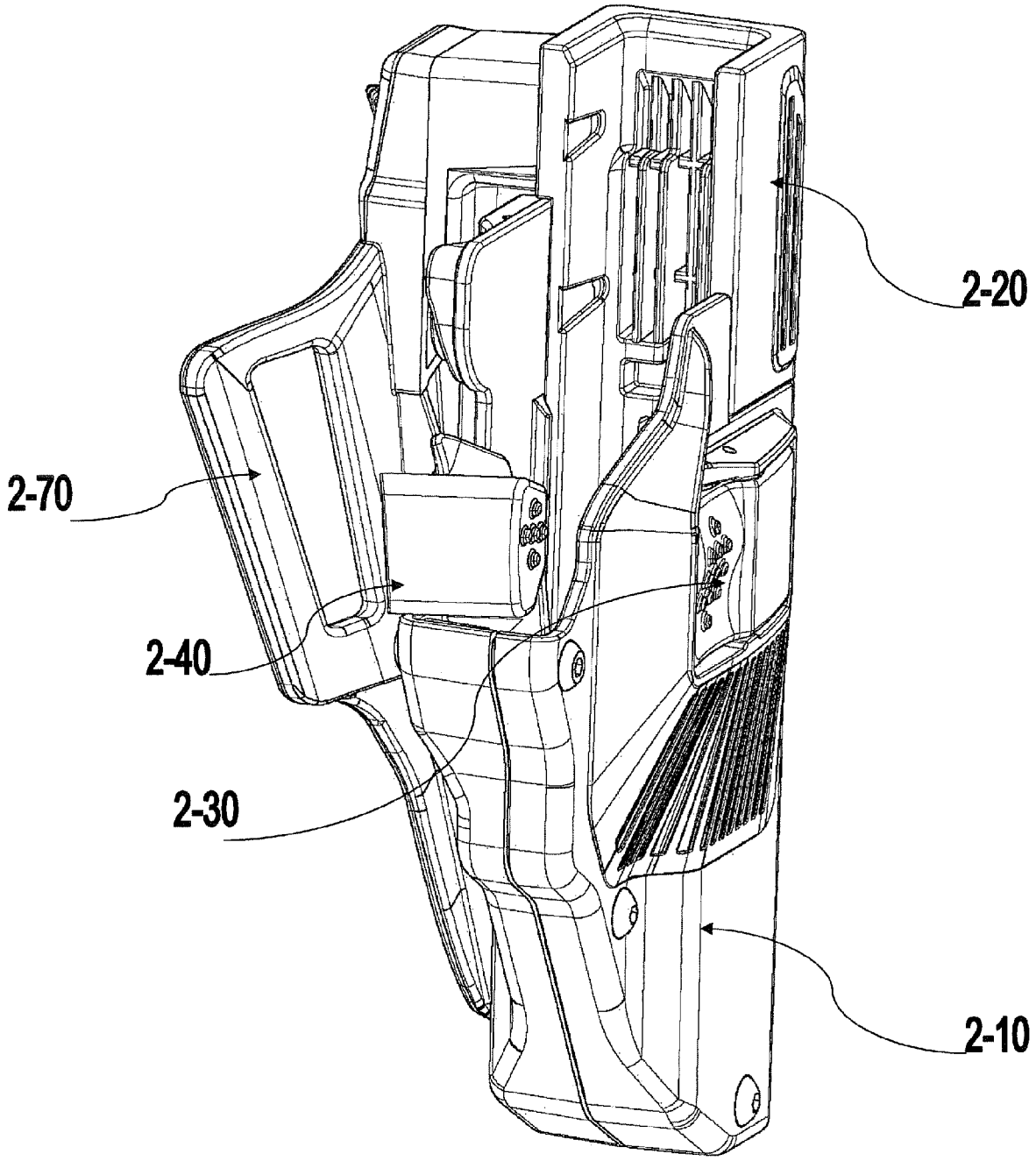
FIG. 2 is a rear perspective view of the self-loading holster carrying a pistol according to an embodiment of the invention.
Figure 3:
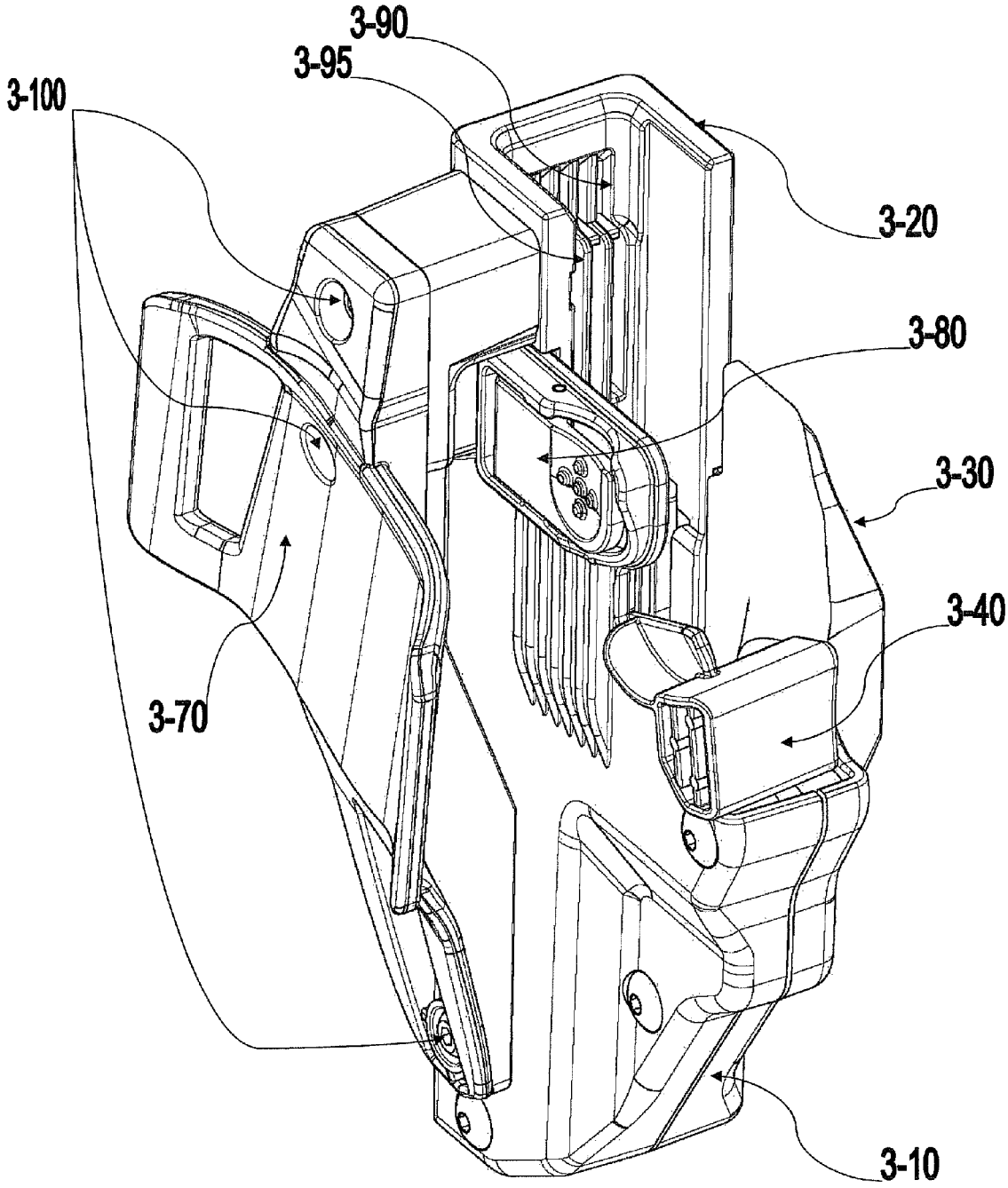
FIG. 3 is a rear perspective view of the self-loading holster with the belt clip attachment component and without a pistol according to an embodiment of the invention.

With reference to FIGS. 1, 2 and 3, the pistol can only be loaded and removed using the self-loading feature of the holster if all three spring-loaded safety release buttons, (2-40), (2-30) (3-80), are depressed simultaneously, disengaging all five releasable locks.

Two spring-loaded safety release buttons are located on either side of the holster, and one release button is at the trigger guard of the pistol, based on the natural position of the thumb, index and middle fingers, when the user puts their hand on the pistol grip. The middle finger lock release button (2-40) releases the locking point on the trigger guard. The index finger lock release button (2-30) releases two releasable locks simultaneously, one on the slide bar, the other on the extract or ejection window, and the thumb lock release button (3-80) disengages the locking point on the slide bar component. The holster's three point lock release configuration requires the user to depress all three pressure release points at the same time, to allow the load and release of the pistol from the five locking points and permit the removal of the pistol from the holster housing unit. To only load the pistol, the index finger (2-30) and thumb lock (3-80) release buttons need to be pressed. To only remove the pistol, the index finger (2-30) and middle finger (2-40) release buttons need to be pressed. In one embodiment, a flange (not shown) extends from the holster body (1-10) to guide the user's index finger, which slides off the holster body (1-10) onto the pistol (1-50) from the index finger lock release button (1-30) as the pistol (1-50) is released from the holster (1-10), to a safe spot on the pistol (1-50), such as on the breech block (not shown), rather than to the trigger (not shown) where the index finger may inadvertently discharge the pistol (1-50).

With reference to FIG. 3, the angle of holster body (3-10) at the side of the user may be adjusted by the use of different belt attachments (3-70) by means of the three metal bolts (3-100).

The alignment of the pistol within the confines of the holster unit is regulated by the sight guard (3-90), using a groove channel guide (3-95) affixed to the inside of the slide bar component (3-20). A wider sight groove of the slide bar component (3-20) is designed to accommodate the rear sights of the pistol (1-50) [not shown]. The groove channel guide (3-95) is specifically molded for a particular pistol model.

The thumb lock release button (3-80) disengages a releasable lock on the slide bar component of the pistol, allowing the unloaded pistol to slide into the holster body (3-10), loading the pistol.

Figure 4:
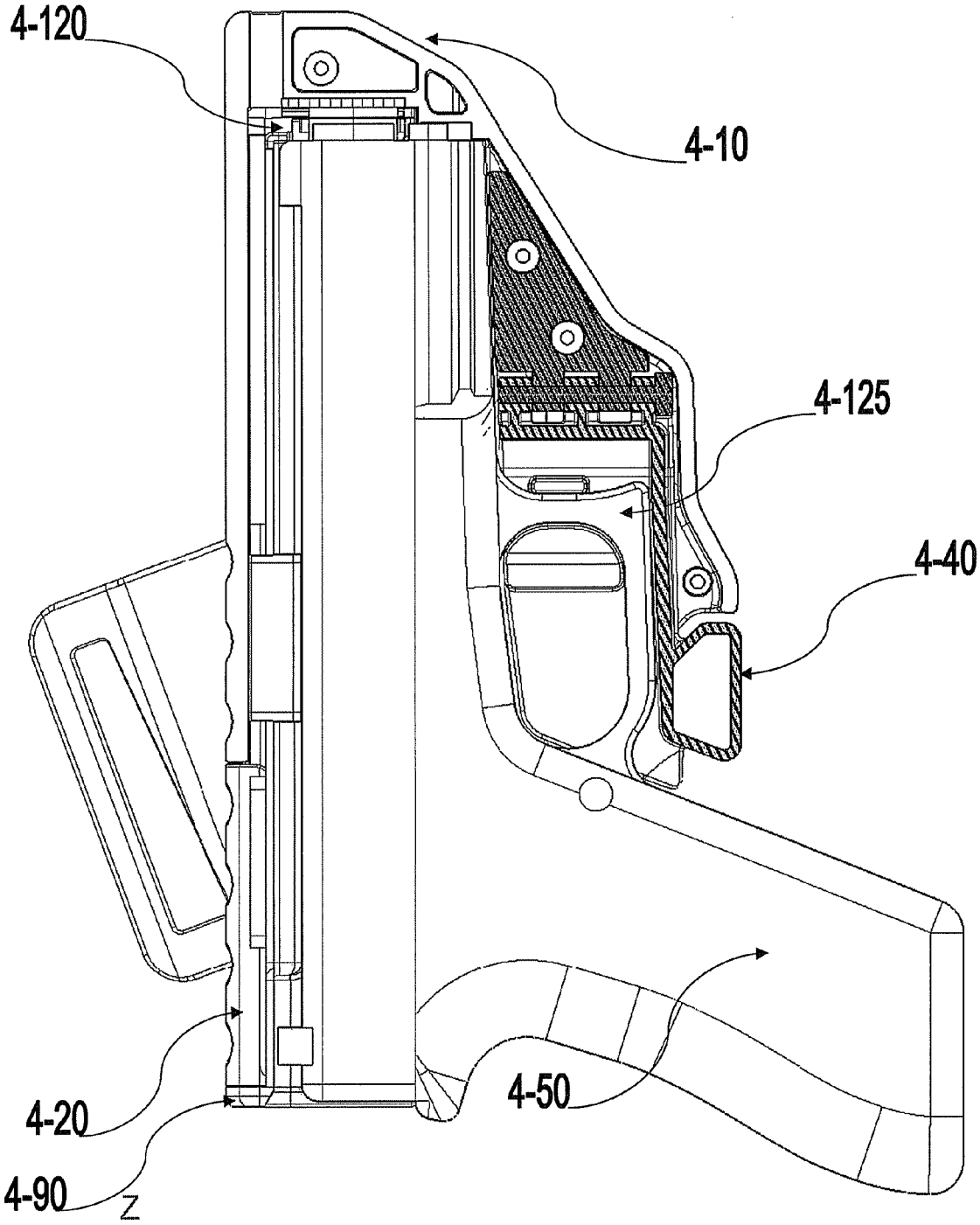
FIG. 4 is a side cut-away view of the self-loading holster, showing a pistol contained within the holster according to an embodiment of the invention.

With reference to FIG. 4, the middle finger lock release button (4-40), when pushed to the side, releases the safety locking point located on the trigger guard (4-125). This is described in detail under the description for FIG. 7. The pistol (4-50) is guided into the holster by means of a sight guard (4-90) in the slide bar component (4-20) of the holster. Once the pistol is within the holster, with the releasable locks described above engaged, the trigger guard (4-125) locks the pistol.

Figure 5:
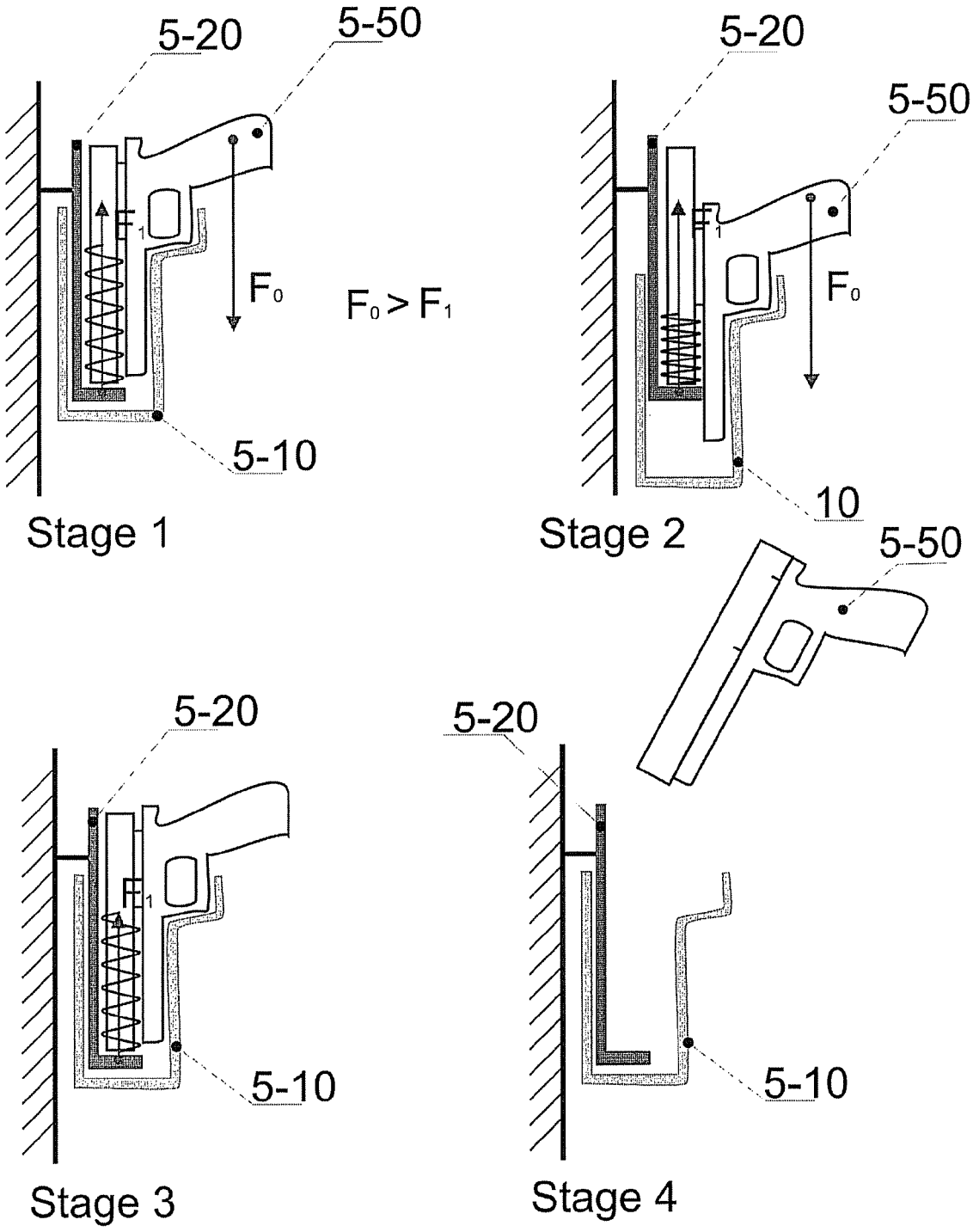
FIG. 5 is a step-by-step view of the self-loading holster, demonstrating the action stages when activating the self-loading feature according to an embodiment of the invention.

With reference to FIG. 5, the four drawings demonstrate the reverse spring-loaded action of the holster for semi-automatic and automatic pistols, an action enabling the pistol to change from an unloaded state, shown in Stage 1 to a loaded state shown in Stage 3, while still in the holster. This functions from the movement of the holster body (5-10) and the slide bar component (5-20) relative to one another, shown in Stage 2. The slide bar component (5-20) remains affixed to the duty belt (1-60) [not shown] by means of belt attachment (2-70) [not shown], securing the upper portion of the pistol, or the "breech block" of the pistol in a fixed position relative to the duty belt (1-60) [not shown]. The holster body (5-10), which contains the lower portion of the pistol (5-50), moves downward, resulting in the loading of a live round of ammunition into the pistol's firing chamber as the breach block and the lower portion of the pistol move relative to one another. The loaded pistol may then be removed and discharged, as shown in Stage 4.

Figure 6:
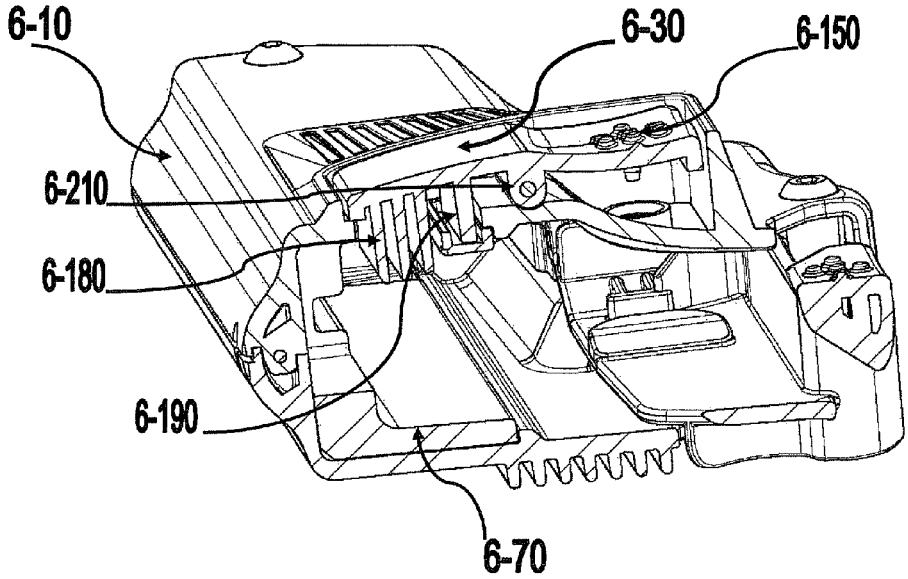
FIG. 6 is a side perspective cut-away view of the spring-loaded locking mechanisms of the self-loading holster according to an embodiment of the invention.
Figure 6:
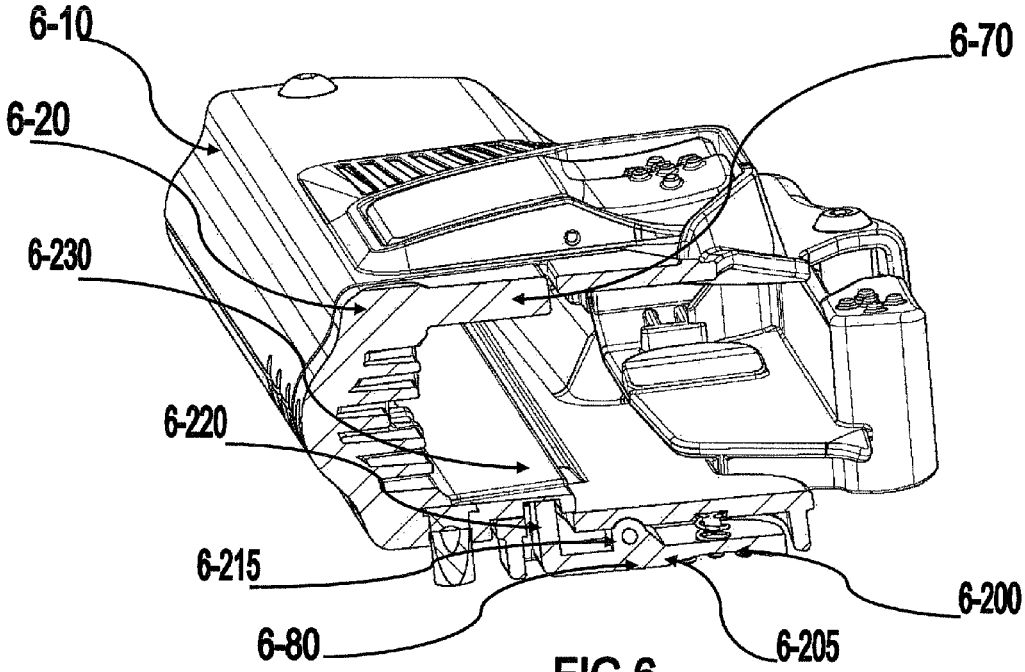

With reference to FIG. 6, the index finger lock release mechanism (6-30), which controls two releasable locks, (6-180, 6-190) is shown. When depressed, the index finger lock release button (6-150) pushes inward, resulting in a flange pivot around the pivot point (6-210), such that lock bar (6-190, 6-180) moves outward, away from the holstered pistol. When the lock bar (6-190, 6-180) moves outward, a slide bar component (6-20) is able to freely slide past the index finger lock release mechanism (6-30), permitting the lower holster body (6-10) to move in relation to the slide bar component (6-20). When the lower holster body component returns to its original closed position, the lock bar (6-190, 6-180) moves inward, toward the holstered pistol, in the locked position, due to the spring-loaded action of flange pivoting around the pivot point (6-210).

With further reference to FIG. 6, the second locking point released by the index finger lock release button (6-150) is located on the extract, or ejection window of the pistol. When the index finger lock release button (6-150) is depressed, it pivots outward the extract window release plate (6-180). When the extract window lock plate (6-180) has been removed from the pistol's extract window [not shown], the pistol (1-50) [not shown] is free to move in and out of the holster, so long as the other releasable locks are disengaged. When the pistol (1-50) [not shown] is introduced into the holster, the extract window lock plate (6-180), which is beveled such that it is pushed to the side as the pistol (1-50) [not shown] pushes past it, the locking plate (6-180) will snap into a locked position, once the pistol is inserted sufficiently into the holster, so that the extract window lock plate (6-180) coincides with the extract window of the pistol (1-50) [not shown].

With further reference to FIG. 6, the thumb lock release mechanism (6-80), which controls one locking point, is shown. When depressed, the thumb lock release button (6-200) pushes down on a spring-loaded flange, which pivots the flange around the pivot point (6-215), such that lock bar (6-220) moves outward, away from the holstered pistol. When the lock bar (6-220) moves outward, a pin (6-230) which is attached to slide bar component (6-20) is able to freely slide past the thumb finger lock release mechanism (6-80), permitting the holster body (6-10) to move in relation to the slide bar component (6-20).

Figure 7:
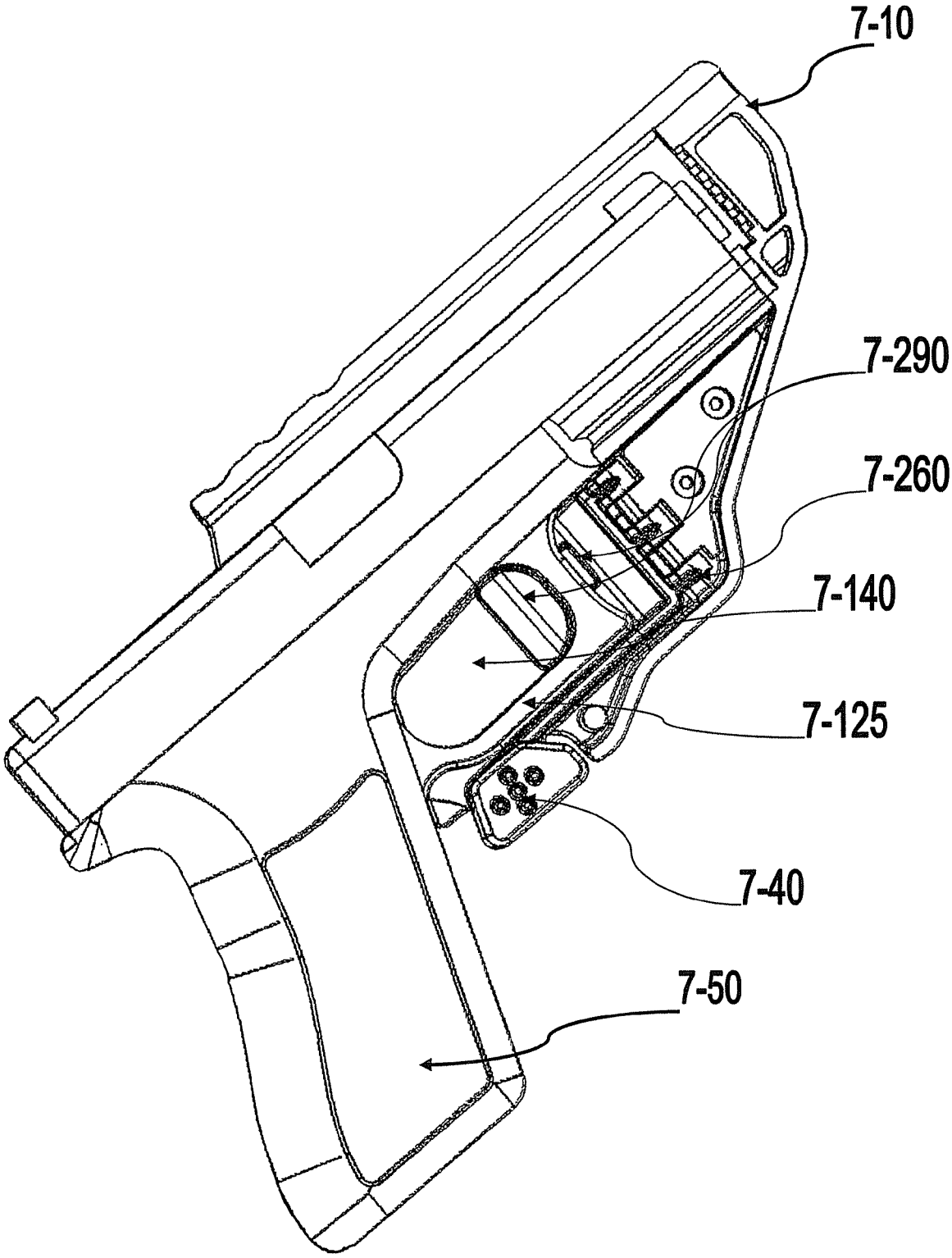
FIG. 7 is a side cut-away view of the trigger guard locking mechanism and the lock release button positioned on the self-loading holster according to an embodiment of the invention.

With reference to FIG. 7, this drawing outlines the operation of the middle finger lock mechanism. The middle finger lock release button (7-40), located near the grip of the pistol (7-50), is depressed by a sideways pressure by the middle finger of the user. The whole middle finger lock mechanism (7-140) also slides sideways within the holster body (7-10), motivated by the middle finger lock button (7-40), which slides sideways on a spring-loaded pin (7-260). When the mechanism slides sideways, the trigger guard flanges (7-290) on either side of the trigger guard (7-125) disengage and slide outwards from the pistol's trigger guard (7-125) and releases the pistol, which may now be removed from the holster, so long as the other releasable locks are also disengaged. When the pistol (7-50) is introduced into the holster, the trigger guard flanges (7-290) are angled and are pushed aside by the trigger guard (7-125), until the trigger guard (7-125) enters the space between the trigger guard flanges (7-290), at which point the spring-loaded pin pulls the middle finger lock mechanism tie rod (7-140) back into a resting position, pulling the trigger guard flanges (7-290) into locked position on either side of the trigger guard (7-125).

Figure 8:
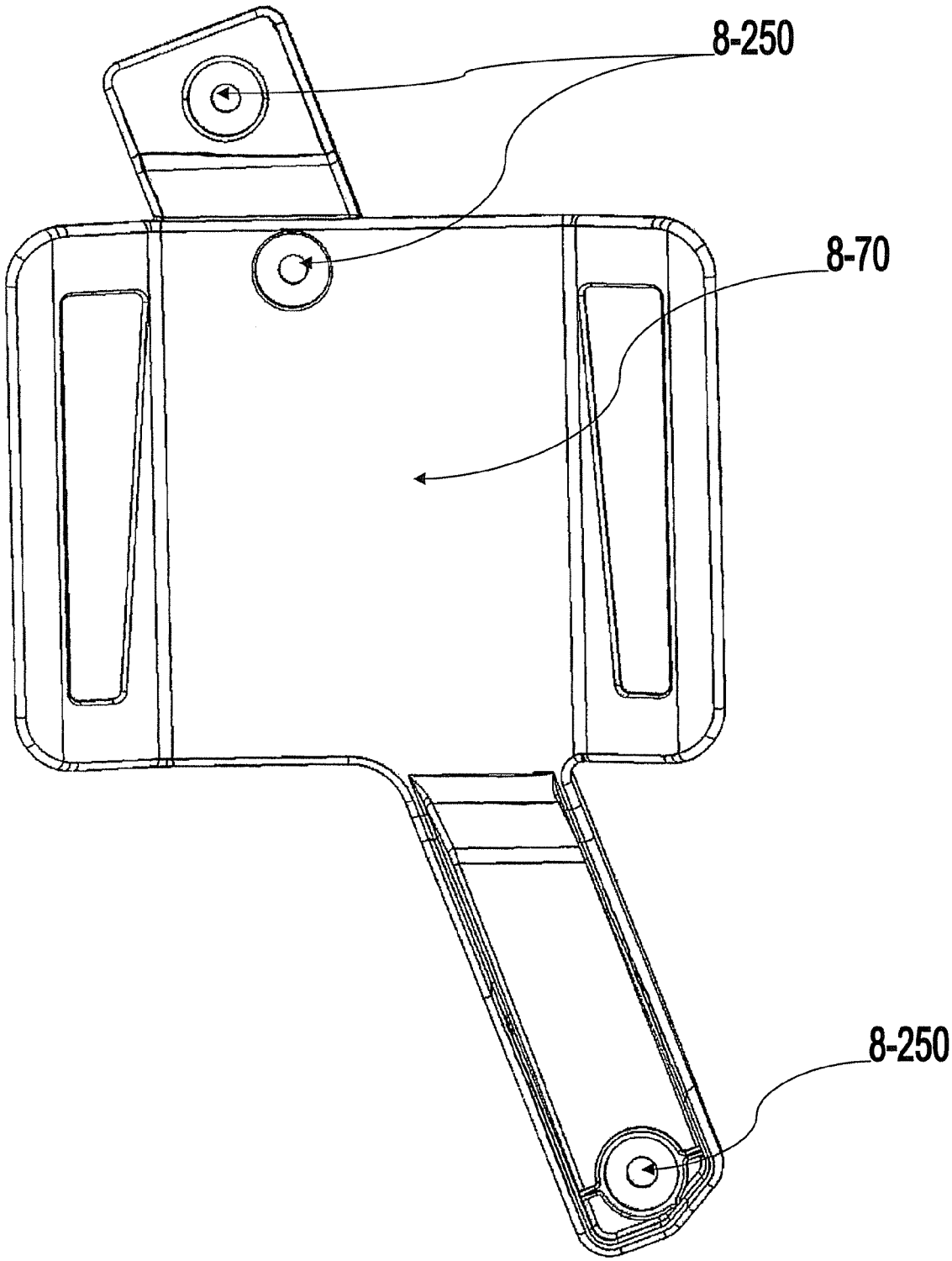
FIG. 8 is a side view of the belt clip attachment which secures the self-loading holster to a user's belt according to an embodiment of the invention.

With reference to FIG. 8, the belt attachment (8-70) is shown indicating the bolt locations (8-250) by which means the holster housing unit is secured to the duty belt attachment.

To activate the self-loading feature of the holster, the officer must depress the three safety lock release buttons simultaneously, these being the index finger lock release button (1-30), the middle finger lock release button (1-40), and the thumb lock release button (3-80), unlocking the five releasable locks, and insert the pistol into the holster body (1-10), resulting in both the pistol (1-50) and the holster body (1-10) to move downward relative to the slide bar component (1-20), which is securing the breach block component of the pistol in a fixed position. The movement of the breach block relative to the pistol body (1-50) loads a live round of ammunition into the firing chamber of the pistol (1-50).

To remove the pre-loaded pistol (1-50) from the holster (1-10), the officer must depress the index finger lock release and the middle finger lock release buttons simultaneously, unlocking the four of the five releasable lock mechanisms, and allowing the removal of the pistol from the holster housing unit.

Figure 9:
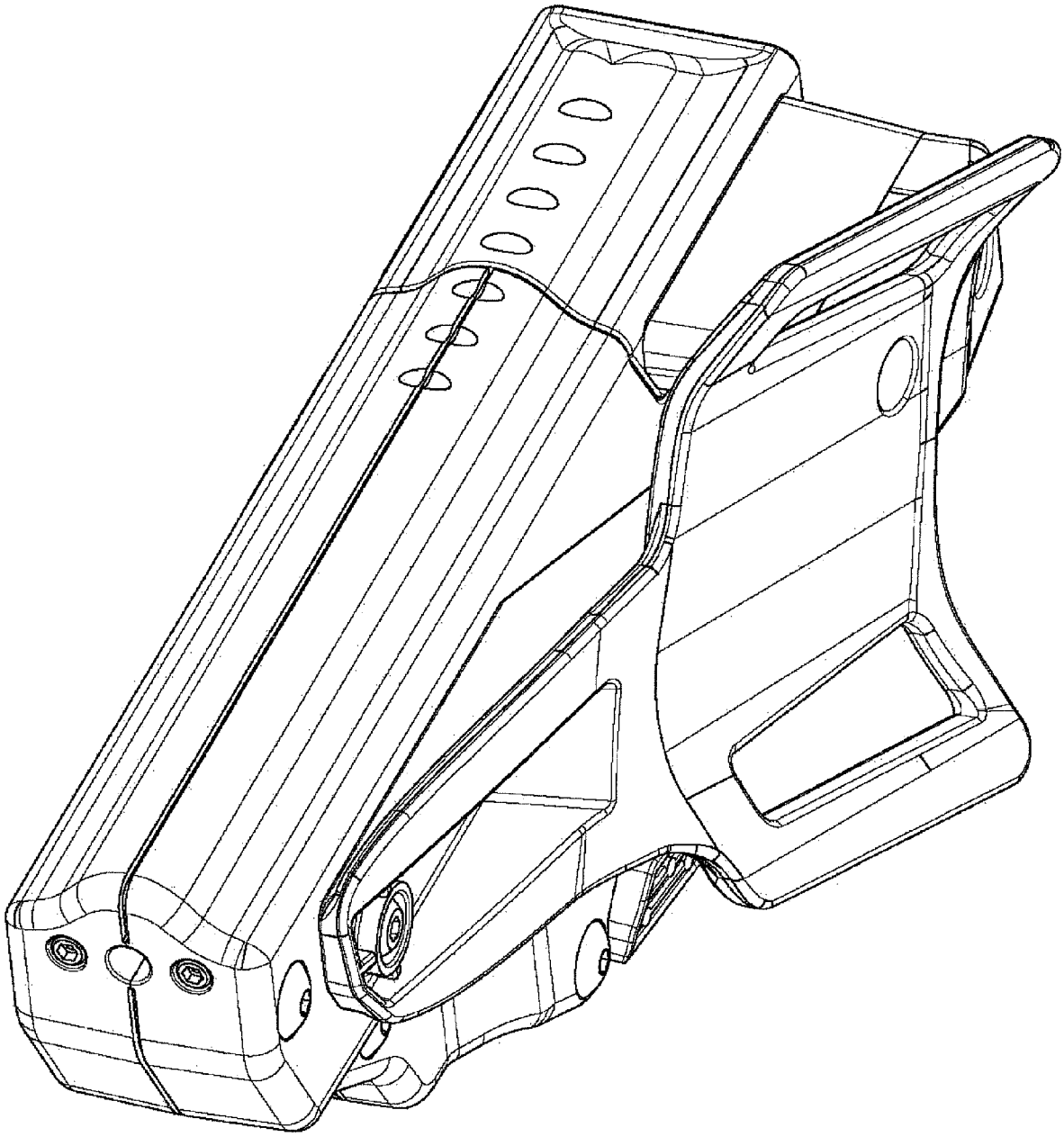
FIG. 9 is a perspective view of the assembled self-loading holster according to an embodiment of the invention.

With reference to FIG. 9, this figure offers a general overview of a pistol inserted into the holster housing unit, and identifies the location of two internal springs, used for the return spring action of the lower holster section, after the self-loading feature has been activated.

A person skilled in the art would appreciate that a releasable lock could be as simple as a leather, or cloth strap, with or without a clasp, that holds the pistol in the holster.

Many modifications and other embodiments of the invention will come to the mind of one skilled in the art having the benefit of the teachings presented in the foregoing description and associated drawings. Therefore, it is understood that the invention is not to be limited to the specific embodiment disclosed, and that modifications and embodiments are intended to be included within the scope of the appended claims.

The invention claimed is:

1. A self-loading holster for a semi-automatic or automatic pistol that has a pistol barrel, comprising a holster body, wherein said holster body includes a pistol barrel containing portion and a trigger guard containing portion, wherein said pistol barrel containing portion includes a slide bar component and a releasable lock, wherein said slide bar component is connected to, and slidable relative to, said holster body, wherein said slide bar component is within said pistol barrel containing portion, wherein sliding of said slide bar component relative to said holster body loads the pistol while the pistol is in said holster, wherein said releasable lock directly links said slide bar component to said holster body, wherein said slide bar component is prevented from sliding relative to said holster body when said releasable lock is engaged, and wherein said slide bar component can slide relative to said holster body when said releasable lock is disengaged.

2. The holster of claim 1, wherein said trigger guard containing portion includes a trigger guard lock, wherein said trigger guard lock includes a first flange, a second flange, and a lock release button, wherein said first flange is configured for engaging a front of a trigger guard of the pistol and wherein said second flange is configured for engaging a rear of the trigger guard of the pistol, wherein pressing said lock release button releases said trigger guard lock on the trigger guard of the pistol.

3. The holster of claim 2, wherein the first flange is angled to be pushed aside by the trigger guard.

4. The holster of claim 1, further comprising a lock release button for releasing said releasable lock.

5. The holster of claim 4, wherein pressing said lock release button releases said releasable lock and allows sliding of said slide bar and loading of the pistol while the pistol is in said holster.

6. The holster of claim 1, further comprising an extract window lock and an extract window lock release button, wherein said extract window lock includes a beveled extract window lock plate, wherein pressing said extract window lock release button releases said extract window lock while the pistol is within said holster.

7. The holster of claim 1, further comprising an attachment connected to said slide bar component.

8. The holster of claim 7, wherein said attachment connected to said slide bar component is a belt attachment.

9. A self-loading holster for a pistol, wherein said pistol includes a pistol barrel, comprising a holster body, wherein said holster body includes a pistol barrel containing portion and a trigger guard containing portion, wherein said pistol barrel containing portion includes a slide bar component and a releasable lock, wherein said slide bar component is positioned so sliding movement of said slide bar component loads the pistol while the pistol is in the holster body, wherein said slide bar component is within said pistol barrel containing portion, wherein when said releasable lock is engaged said slide bar component is prevented from sliding relative to said holster body, and wherein when said releasable lock is disengaged said slide bar component can slide relative to said holster body and load the pistol.

10. A self-loading holster for a semi-automatic or automatic pistol having an extract window, comprising a holster body, a slide bar component, a releasable lock, a lock release button, and an extract window lock, wherein said slide bar component is operatively connected to, and slidable relative to, the holster body, wherein sliding of said slide bar component relative to said holster body loads the pistol while the pistol is in said holster, wherein said releasable lock directly links said slide bar component to said holster body, wherein said slide bar component is prevented from sliding relative to said holster body when said releasable lock is engaged, and wherein said slide bar component can slide relative to said holster body when said releasable lock is disengaged, wherein said extract window lock is in the extract window of the pistol when the pistol is in the holster, wherein pressing said lock release button simultaneously releases both said extract window lock of the pistol in said holster and said releasable lock.

* * * * *